US006450493B1

(12) United States Patent
Milillo et al.

(10) Patent No.: US 6,450,493 B1
(45) Date of Patent: Sep. 17, 2002

(54) IMAGE TRANSFER APPARATUS SHUTTLE FEEDER MODULE

(75) Inventors: William D. Milillo, Ontario; Eugene F. Miller; Joseph Marasco, both of Fairport, all of NY (US)

(73) Assignee: Xerox Corporation, Stamford, CT (US)

( * ) Notice: Subject to any disclaimer, the term of this patent is extended or adjusted under 35 U.S.C. 154(b) by 0 days.

(21) Appl. No.: 09/732,310

(22) Filed: Dec. 7, 2000

(51) Int. Cl.[7] ..... B65H 5/08

(52) U.S. Cl. ..... 271/11; 271/98; 271/105; 271/107

(58) Field of Search ..... 271/11, 14, 98, 271/105, 107, 5

(56) References Cited

U.S. PATENT DOCUMENTS

| | | | | |
|---|---|---|---|---|
| 2,085,612 A | * | 6/1937 | Spiess | 271/98 |
| 3,294,396 A | * | 12/1966 | Staines | 271/98 |
| 5,092,578 A | * | 3/1992 | Bergmeier et al. | 271/105 |
| 5,110,110 A | * | 5/1992 | Wirz et al. | 271/98 |
| 6,135,437 A | * | 10/2000 | Maass et al. | 271/11 |
| 6,155,555 A | * | 12/2000 | Maass | 271/98 |

FOREIGN PATENT DOCUMENTS

| | | | | |
|---|---|---|---|---|
| GB | 1547776 | * | 6/1979 | 271/98 |
| JP | 0300033 | * | 12/1990 | 271/98 |

* cited by examiner

*Primary Examiner*—H. Grant Skaggs
(74) *Attorney, Agent, or Firm*—Perman & Green, LLP

(57) ABSTRACT

An image transfer apparatus shuttle feeder module comprising a module frame, an air fluffer assembly, a vacuum shuttle box assembly, and an air knife assembly. The air fluffer assembly is supported from the module frame. The vacuum shuttle box assembly is supported from the module frame. The air knife assembly is supported from the module frame. The vacuum shuttle box assembly is movably mounted to the module frame to shuttle relative to the frame between first and second positions. The module frame has attachment members adapted for removably mounting the module frame with the air fluffer assembly, vacuum shuttle box assembly, and air knife assembly thereon to an image transfer apparatus. The image transfer apparatus has a sheet media supply section. The module frame is mounted in a predetermined location on the image transfer apparatus. In the predetermined location the module frame is disposed relative to the sheet media supply section such that the air fluffer assembly, the vacuum shuttle box assembly and air knife assembly are operable for moving sheet media from the supply section to a different location on the image transfer apparatus.

21 Claims, 7 Drawing Sheets

FIG. 5
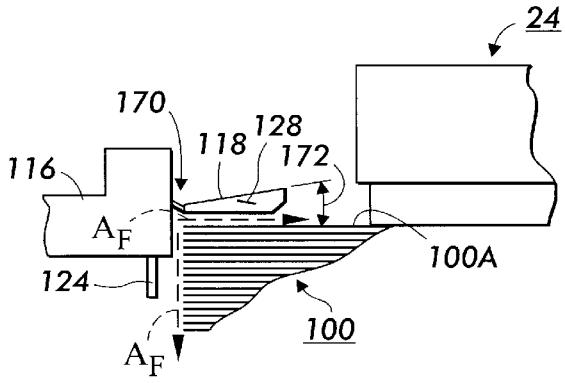
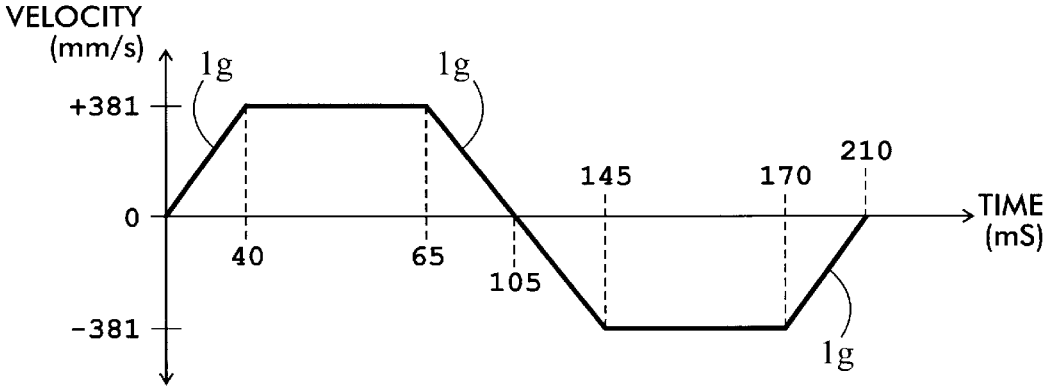
FIG. 6

IMAGE TRANSFER APPARATUS SHUTTLE FEEDER MODULE

BACKGROUND OF THE INVENTION

1. Field of the Invention

The present invention relates to a sheet media transport system in an image transfer device and, more particularly, to a modular shuttle feeder for transporting sheet media in an image transfer device.

2. Prior Art

Conventional image transfer apparatus such as copiers or printers may include a paper transport system for transporting sheets of paper from a paper supply area, through the apparatus and into an output tray or section of the apparatus. Some paper transport systems in conventional image transfer apparatus may be less complex. Such transport systems may comprise a number of take away rollers which are pressed against a top sheet of a paper stack in the supply area. When the rollers are rotated, the rollers draw the top sheet from the stack and feed it to subsequent rollers which transport the sheet through the apparatus. These transport systems may operate well when transporting plain bond paper, but are subject to jamming and misfeeds when operating with coated sheets of paper. Coated sheets of paper, such as for example, gloss paper used for high quality color prints, have a significantly higher coefficient of friction than bond paper, and sheets of coated paper are more likely to stick together when stacked. To handle coated paper, conventional image transport apparatus may be provided with more sophisticated paper transport systems. Such transport systems generally include a shuttle which moves sheets of paper from the stack in the supply area to take away rollers of the transport system. The shuttle may be provided with vacuum suction to help capture sheets of paper from the stack. Additionally, these transport systems may have an air fluffer, to facilitate separation of sheets in the stack, and an air knife to further ensure the shuttle does not transport multiple sheets of paper to the take-away rollers. In the image transfer apparatus of the prior art, each of the systems making up the paper transport system, such as the shuttle, the air fluffer, and the air knife are installed individually in the apparatus when the apparatus is being manufactured. Access to install the shuttle, the air fluffer, and air knife is restricted by the limited size of access panels in the apparatus frame. Hence, installation of the transport system in the prior art is time consuming and expensive. Furthermore, as the systems are installed generally independently of each other, access through the access panels becomes increasingly more limited so that serviceability of the systems after manufacture may be performed after significant disassembly of the apparatus. The present invention overcomes the problems of the prior art as will be described below.

SUMMARY OF THE INVENTION

In accordance with a first embodiment of the present invention, an image transfer apparatus shuttle feeder module is provided. The module comprises a module frame, an air fluffer assembly, a vacuum shuttle box assembly, and an air knife assembly. The air fluffer assembly is supported from the module frame. The vacuum shuttle box assembly, and air knife assembly are also supported from the module frame. The vacuum shuttle box assembly is movably mounted to the module frame to shuttle relative to the frame between first and second positions. The module frame has attachment members adapted for removably mounting the module frame with the air fluffer assembly, vacuum shuttle box assembly, and air knife assembly thereon, to an image transfer apparatus. The image transfer apparatus has a sheet media supply section. The module frame is mounted in a predetermined location on the image transfer apparatus when the module frame is mounted to the image transfer device. In the predetermined location, the module frame is disposed relative to the sheet media supply section such that the air fluffer assembly, the vacuum shuttle box assembly, and air knife assembly are operable for moving sheet media from the supply section to a different location on the image transfer apparatus.

In accordance with a second embodiment of the present invention, an image transfer apparatus is provided. The image transfer apparatus comprises a frame, an imager, a media supply section, a sheet media transport system, and a shuttle feeder module. The imager is mounted on the frame for generating an image on sheet media. The media supply section is connected to the frame for holding sheet media thereon. The sheet media transport system is connected to the frame for transporting sheet media to the imager. The shuttle feeder module is removably mounted to the frame for feeding sheet media from the media supply section to the sheet media transport system. The shutter feeder module has an air fluffer assembly, a vacuum shuttle box assembly, and an air knife assembly integral to the shutter feeder module. The air fluffer assembly, vacuum shuttle box assembly, and air knife assembly are configured on the shuttle feeder module to be removably connected to the frame substantially at the same time when the shutter feeder module is mounted to the frame.

In accordance with the method of the present invention, a method for manufacturing an image transfer apparatus is provided. The method comprises the steps of providing the image transfer apparatus with a frame, attaching an air fluffer assembly, a vacuum shuttle box assembly, and an air knife assembly to a module frame for forming an integral shuttle feeder module, and mounting the shuttle feeder module to the image transfer apparatus. The frame of the image transfer apparatus has an imager, a media supply section, and a media transport system mounted to the frame. The shuttle feeder module is mounted as a unit to the frame of the image transfer apparatus. The air fluffer assembly, vacuum shuttle box assembly, and air knife assembly integral to the shuttle feeder module are connected to the frame of the image transfer apparatus in one step when the shutter feeder module is mounted to the frame.

BRIEF DESCRIPTION OF THE DRAWINGS

The foregoing aspects and other features of the present invention are explained in the following description, taken in connection with the accompanying drawings, wherein:

FIG. 5 is a schematic partial end elevation view of an air knife assembly nozzle of the shuttle feeder module in FIG. 2, and the sheet media supply section of the image transfer apparatus; and FIG. 6 is a graph showing a velocity profile of a vacuum shuttle box of the feeder module shown in FIG. 2, when the shuttle box is cycled between rear and front positions.

DETAILED DESCRIPTION OF THE PREFERRED EMBODIMENT

Figure 1:
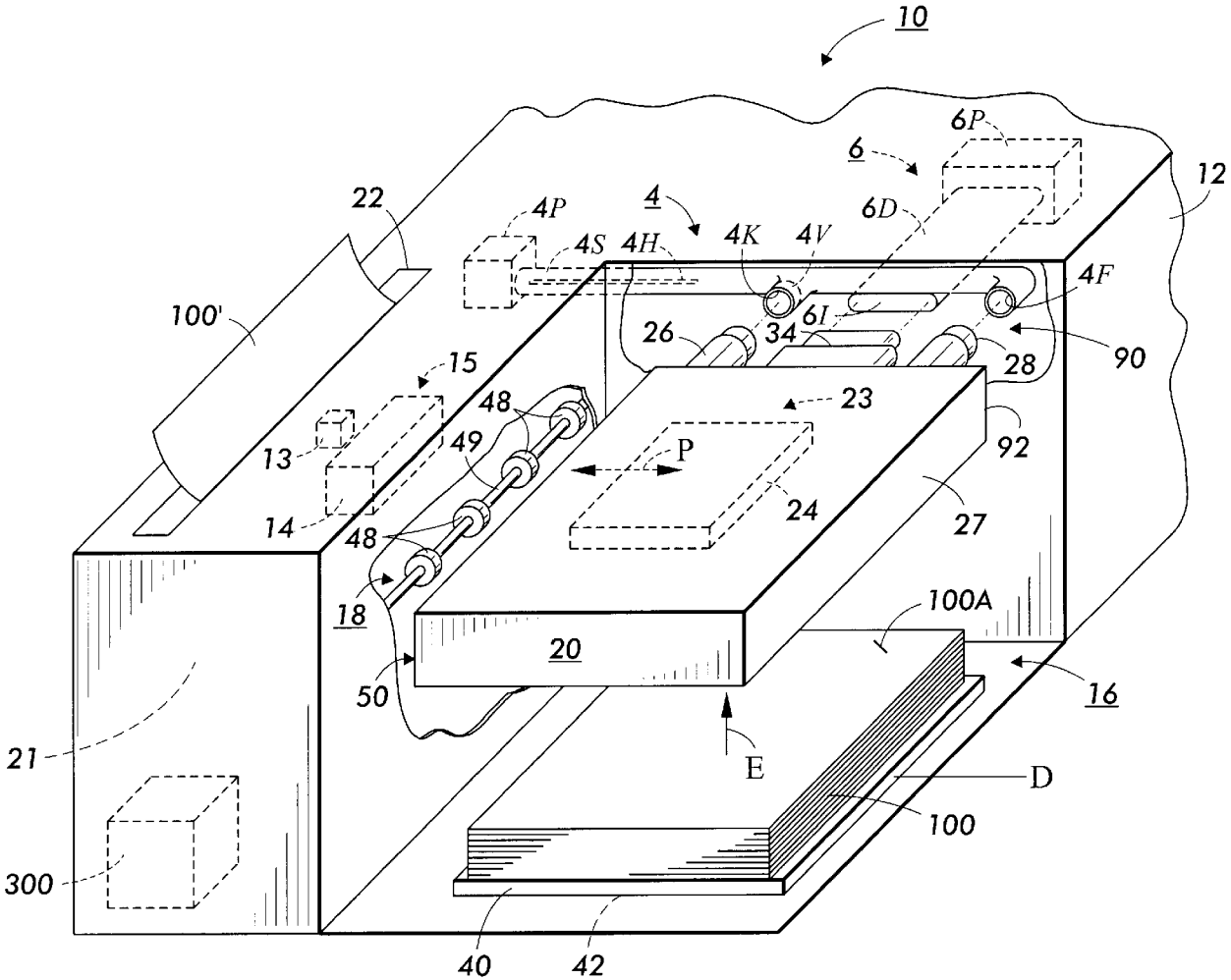
FIG. 1 is an exploded perspective view of an image transfer apparatus incorporating features of the present invention.

Referring to FIG. 1, there is shown an exploded perspective view of an image transfer apparatus 10 incorporating features of the present invention. Although the present invention will be described with reference to the single embodiment shown in the drawings, it should be understood that the present invention can be embodied in many alternate forms of embodiments. In addition, any suitable size, shape or type of elements or materials could be used.

Still referring to FIG. 1, the image transfer apparatus 10 is preferably an electro-photographic image transfer apparatus, such as for example, a color copier, printer, of multi-function device, though the present invention is equally applicable to any other type of electro-photographic, or electronic image transfer device. The image transfer apparatus 10 generally comprises a frame 12 which supports an imaging section 14, a sheet media supply section 16, a sheet media output section or tray 22, and a transport system 18. The sheet media supply section 16 holds a supply of blank sheet media 100 therein. The imaging section 14 generates an image on sheet media 100. The output tray 22 holds the sheet media 100' after an image is generated on the media. Transport system 18 transports blank sheet media 100 from the supply section 16 to the imaging section 14, where an image is formed on the sheet media, and then to the output tray 22 into which the sheet media is ejected. The sheet media 100 may comprise sheets of bond paper, or may be coated paper used for making color copies. Factors such as static electrical charges on the sheet media, or atmospheric moisture may cause several sheets of the sheet media 100 to cling together in the supply section 16. This in turn may cause the transport system to misfeed paper, or jam, especially when the transport system 18 is operating at high feed rates such as about 120 ppm (pages per minute) or more. The apparatus 10 is also provided with an air supply system 4, and a vacuum system 6, which are mounted to the frame 12. The air supply system 4 provides an air supply to an air fluffer assembly, and an air knife assembly to facilitate separation of sheet media sheets being transported by the transport system 18 from the supply section 16 as will be described in greater detail below. The vacuum system 6 provides suction to maintain the sheet media on the transport system 18 as will also be further described below. As can be seen in FIG. 1, the image transfer apparatus 10 further includes a removable module 20. The removable module 20 has an input portion 23 of the transport system 18 which is used to capture sheet media 100 in the supply section 16 and to carry the sheet media 100 from the supply section 16 to an adjoining portion 23 of the transport system 18. The module 20 is removably mounted to the frame 12 of the apparatus and may be installed and removed as a unit. When access to the input portion 23 of the transport system 18 is desired, such as for example to make some adjustments, the module 20 may be removed from the frame 12 thereby allowing substantially unencumbered access to portion 23 of the transport system 18. Also, if a portion of the transport system 18 is to be replaced, the module 20 may be replaced with another module which is then mounted to the frame in place of the original module.

In greater detail now, and still referring to FIG. 1, the imaging section 14 of the image transfer apparatus 10 preferably includes a removable cartridge 15 with a toner supply section (not shown), a photoreceptor (not shown), a developer (not shown), and a fuser (not shown). In alternate embodiments, the toner supply section, developer, and fuser may be individually mounted to the frame of the apparatus. The imaging section 14 of the apparatus also includes an imager 13 such as for example, a raster output scanner (ROS) laser, though any other suitable type of electro-photographic, or electro-optic imager may be used. The ROS imager 13 generates a latent image on the photoreceptor. The developer in cartridge 15 deposits a controlled amount of toner from the toner supply section onto the photoreceptor to develop the latent image on the photoreceptor. The photoreceptor in cartridge 15 may be brought into contact with, or otherwise transfer the developed image onto blank sheet media 100 transported to the imaging section 14 by the transport system 18. The fuser fixes the image on the sheet media which is then removed from the imaging section by the transport system 18.

The sheet media supply section 16 preferably includes one, or more holding trays 40 (only one tray is shown in FIG. 1 for example purposes). Each tray 40 is configured to hold a stack of sheet media 100. Different trays of the apparatus may hold sheet media of different sizes, such as for example, 8½×11 inch paper sheets, 11×14 inch paper sheets, A4 paper sheets, of different materials, such as for example, coated paper, bond paper, or transparencies. The present invention applies equally to any size, material, or configuration of sheet media held by the trays of the apparatus. Tray 40 may be provided with a suitable elevating mechanism 42 which moves the tray 40 from a down position D (shown in FIG. 1) to an up position U (see also FIG. 4A). The elevating mechanism may be a suitable electromechanical mechanism, such as for example, an electric motor driving a set of rollers on rails to move the tray 40 vertically in the direction indicated by arrow E between the down position D and the up position. Otherwise, the elevating mechanism may be an electro-hydraulic piston, or a spring, or series of springs, biasing the tray to the up position. The tray 40 may be lowered by the user to the down position D in order to replenish sheet media 100 in the tray. After sheet media 100 is added, the tray 40 may be raised automatically to the up position U. When the tray 40 is in the up position U, the top sheet 100A (see FIG. 4A) is in a proper position in which the input portion of the transport system 18 may adequately capture, and commence transport of the sheet media 100A as will be further described below. As top sheet 100A on the sheet media stack in the tray 40 is removed from the transport system 18, the elevating mechanism 42 adjust the position of the tray so that the next top sheet of the sheet media stack is maintained at position U. In the case the elevating mechanism 42 is an electro-mechanical mechanism as described above, the apparatus 10 preferably includes a position sensor 144, such as an electro-optical sensor, which senses the height of the top sheet 100A on the sheet media stack in tray 40. The sensor 144 may be connected to a controller 300 (see FIG. 1), for sending signals to the controller indicating when the top sheet 100A is in the proper position U, and when the sheet is not in the proper position. When the controller 300 registers that the top sheet 100A is not in its proper position, the controller may operate the elevating mechanism 42 to raise the tray 40 and bring the top sheet 100A into position U. The controller stops the elevating mechanism upon receiving the signal from sensor 144 that the top sheet 100A is in position U.

The transport system 18 of the image transfer apparatus 10 includes a general sheet media input section 23 and a series of rollers arranged in a train 21 of which only following rollers 48 are shown in FIG. 1 for example purposes. The input section 23 is mounted on the removable module 20 and will be described in greater detail below. Following rollers 48 are the foremost rollers in the train 21, and receive sheet media delivered by the input section 23. Following rollers 48 are mounted on a shaft 49 extending transverse to the process direction (indicated by arrow P) in which the sheet media is moved by the transport system 18 from the sheet media supply section 16 of the apparatus. Rollers 48 are powered by a suitable electromotive drive system which rotates the rollers 48 in order to carry the sheet media in the process direction P. The other rollers of the roller train 21 are substantially similar to following rollers 48. The rollers of train 21 are located as desired within the frame 12 of the apparatus to allow sheet media to move over the rollers to the imager section 14 and then out into the output tray 22. One or more of the series of rollers making up the train 21 may also be powered to move the sheet media over the rollers.

Figure 2:
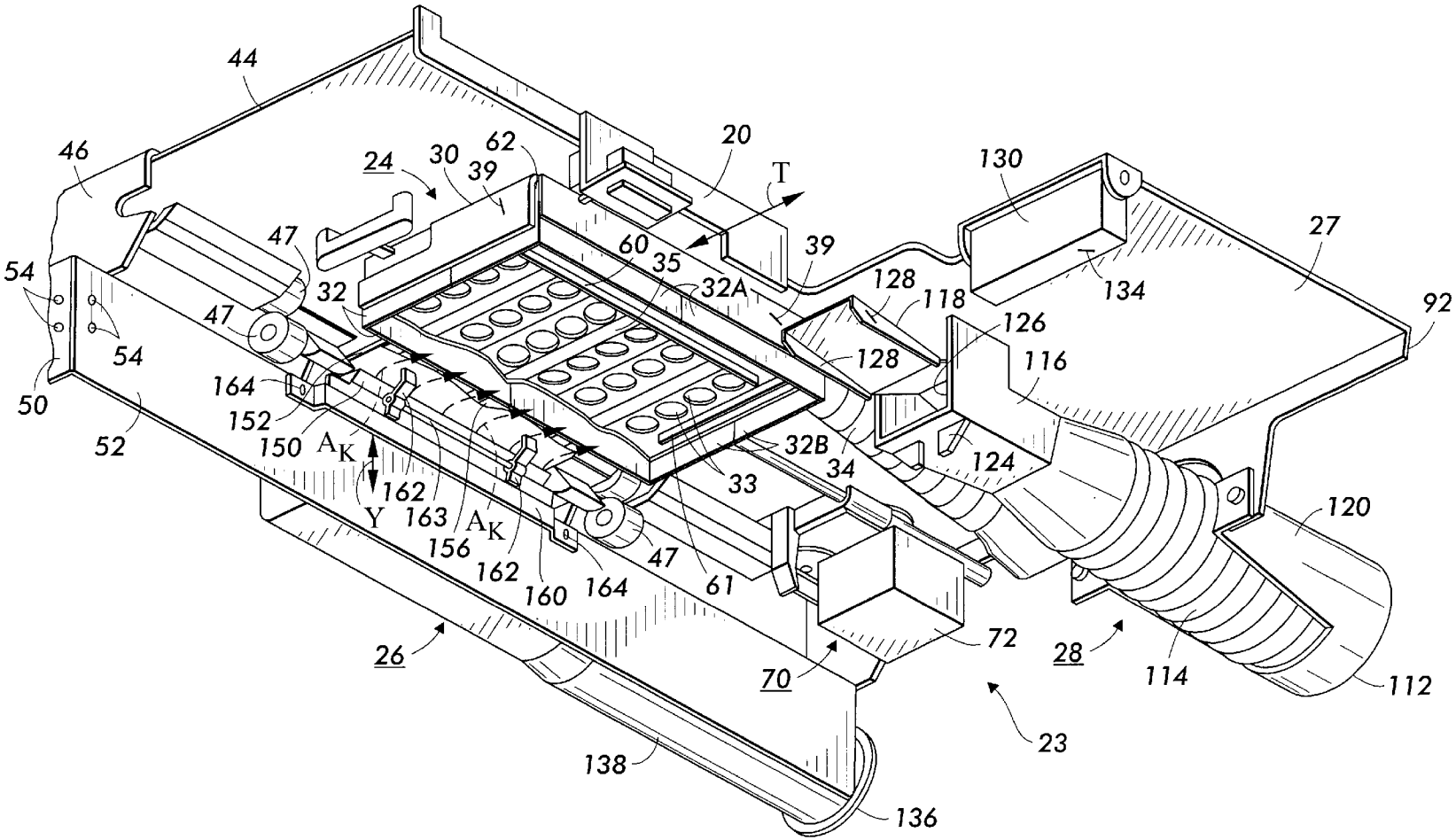
FIG. 2, is a bottom perspective view of a shuttle feeder module of the image transfer apparatus shown in FIG. 1.
Figure 3:
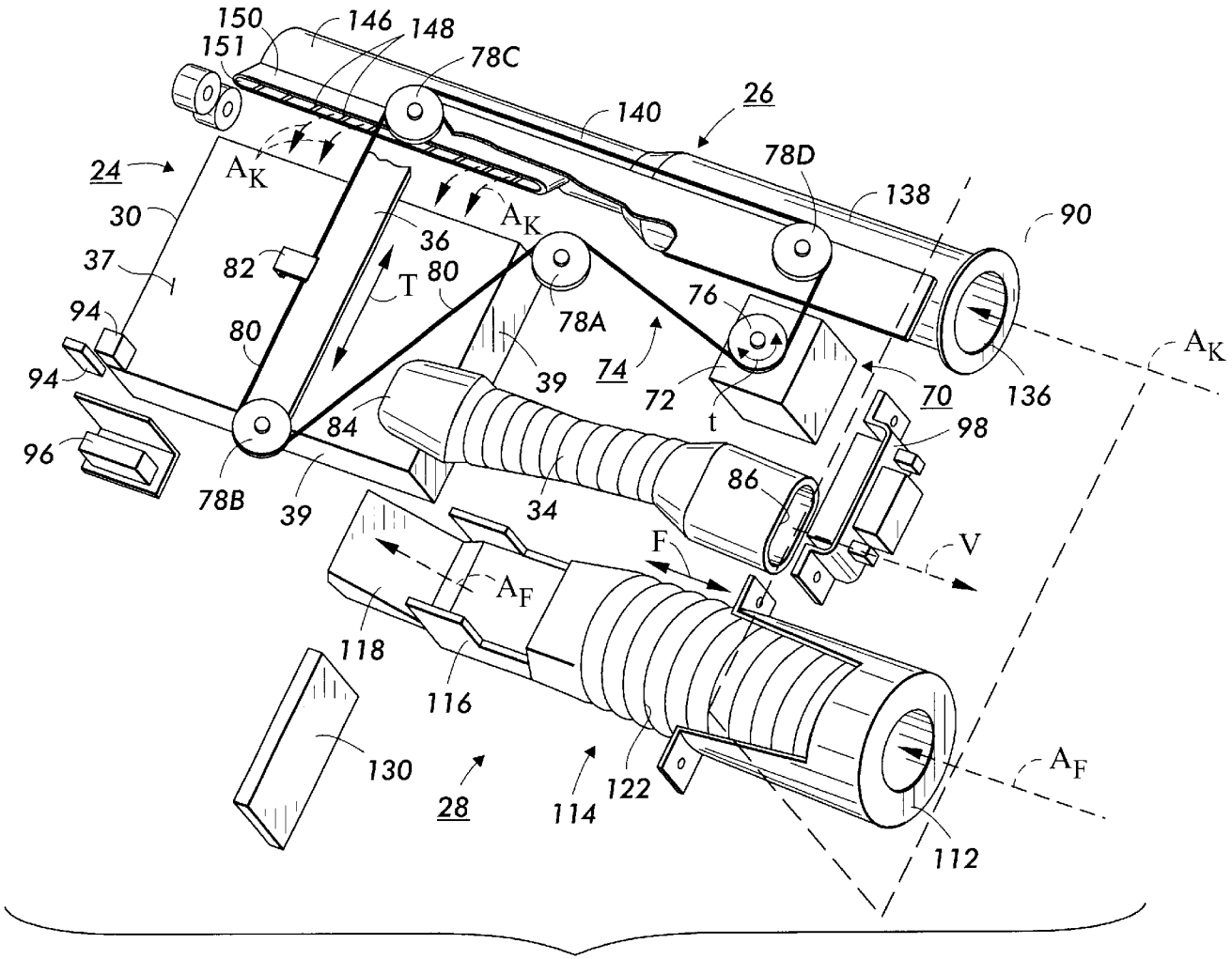
FIG. 3, is a top perspective view of the shuttle feeder module shown in FIG. 2, with the module frame omitted for clarity.

Referring now also to FIGS. 2 and 3, there is shown respectively a schematic bottom perspective view of the removable module 20 holding the input section 23 of the apparatus transport system 18, and a schematic top perspective view of the input section 23 supported by the module 20. The input section 23 of the transport system 18 generally comprises vacuum shuttle box assembly 24, air fluffer assembly 28, and air knife assembly 26. The input section 23 may also include take-away rollers 47. Module 20 has a frame 21 which supports the vacuum shuttle box assembly 24, air fluffer assembly 28, air knife assembly 26, and rollers 47 of the input section 23. (Frame 21 is omitted in FIG. 3 for purposes of clarity.) The module frame 21 may be made from plastic, or any suitable metal such as for example, aluminum alloy, or steel. In the preferred embodiment, the frame 21 comprises a horizontal support plate 44. The support plate 44 is located at the top of the module 20. The horizontal support plate 44 may have brackets or support members depending therefrom for mounting the module 20 to the apparatus 12. By way of example, support brackets 46 depend from the lower surface of the support plate 44 holding mounting rail 52 at the front edge 50 of the module frame 21 (see FIG. 2). The mounting rail 52 is configured to abut against a portion of the frame 12 of the apparatus 10. The mounting rail 42 may have a suitable number of fastener holes 54 formed therein for through fasteners (not shown) used to attach the module 20 to the apparatus frame 12. In alternate embodiments, the frame of the module may include any other number of mounting brackets located at any other suitable location for mounting the module to the apparatus. In other alternate embodiments, the mounting brackets may include horizontal support rails for slidably engaging the module to conjugal support rails on the apparatus.

The vacuum shuttle box assembly 24 generally comprises a vacuum shuttle box 30, a slide rail 36, and vacuum hose 34. In the preferred embodiment, the vacuum shuttle box 30 has a general hexahedron shape with a top plate 37 four sidewalls 39, and a bottom plate 35. In alternate embodiments, the shuttle box may have any other suitable shape so that the box defines a chamber therein. As seen best in FIG. 2, the bottom plate 35 is perforated with a number of suction holes 33 formed therein. The suction holes 33, which may be of any suitable size, may be arranged in rows, and columns. Otherwise, the holes may be arranged in any other suitable pattern. The bottom plate 35 preferably has a somewhat convoluted, or rippled shape, as shown in FIG. 2, with pitched sections of the plate forming a general zig-zag pattern. The bottom plate 35 may also have a rear rib 60 and a side rib 61 projecting downward from the bottom plate. In alternate embodiments, the bottom plate may have any other suitable shape including being substantially flat. The vacuum shuttle box 30 includes skirt 32 which is slidably mounted to the box around the perimeter of the bottom plate 35. The skirt 32 is made out of sections 32A, 32B. Skirt sections 32A are mounted along the lateral walls of the box, and skirt sections 32B are mounted along the longitudinal walls of the box. Otherwise, skirt sections 32A, 32B are substantially similar to each other. Each skirt section 32A, 32B is preferably a thin flat sheet made from Mylar, though in alternate embodiments, the skirt sections may be made from any other suitable plastic or metal sheet. In the preferred embodiment, the combined weight of the skirt sections 32A, 32B forming the skirt 32 on the box 30 is about 8.0 gm, though the skirt may have any other suitable weight sufficient to allow the skirt to be raised by the vacuum in the shuttle box 30 as will be described in greater detail below. The skirt sections 32A, 32B are mounted in vertical slots 62 formed in the sidewalls of the box 30. The slots 62 allow the skirt sections 32A, 32B, and hence, the skirt 32, to move vertically a distance in excess of about 8.0 mm. Slide rail 36, shown in FIG. 3, is fixedly mounted to the module frame 21. The slide rail 36 may have a longitudinal slot, or groove (not shown) to slidably engage a slider (not shown) depending from the top plate 37 of the vacuum shuttle box 30. In the preferred embodiment, the vacuum shuttle box 30 is centered below the slide rail 36, though in alternate embodiments, the vacuum box and the slide rail may have any other suitable position relative to each other. The vacuum shuttle box 30 is thus capable of sliding back and forth a long rail 36 relative to the module 20 in the direction indicated by arrow T.

The module 20 includes a drive system 70 for sliding the vacuum shuttle box 30 on the rail 36. FIGS. 2 and 3 respectively show an example of a suitable drive system for moving the vacuum shuttle box 30, though any other suitable drive system may be used. The drive system 70 comprises an electric motor 72, and a drive train 74 connecting the motor 72 to the vacuum shuttle box 30. The motor 72 may be a stepper motor such as for example, a bi-polar 24 volt, 1.4 amp, 1 phase DC motor, as made by Shinano Kenshi Model STP42D241, or equivalent motor. The stepper motor 72 may be capable of about 200 steps per revolution. The drive train 74 comprises a series of pulleys 76, 78A–78D and the transmission belt or cable 80. Drive pulley 76 is mounted to the output shaft of the stepper motor 72. The idler pulleys 78A–78D are pivotably mounted by respective shafts to the horizontal support plate 44 of the module 20 as shown in FIG. 3. Two idler pulleys 78B, 78C are mounted at the front and rear ends of the slide rail 36. The transmission cable 80 is wound around the pulleys 76, 78A–78D. The top plate 37 of the shuttle box 30 has a clamp fixture 82 projecting therefrom which grips the transmission cable 80 so that shuttle box 30 and cable 80 move together. Stepper motor 72 rotates the drive pulley 76 which effects movement of the transmission cable 80 around the pulleys 76, 78A–78D of drive train 74. Between pulleys 78B–78C, the transmission cable 80 moves substantially parallel to slide rail 36, and hence, causes the vacuum shuttle box 30 which is fixedly connected to the cable 80 to move along the rail 36 in the direction indicated by arrow T. By way of example, in the case the stepper motor 72 turns the drive pulley 76 counter-clockwise, as indicated by arrow t in FIG. 3), the cable 80 between pulleys 78B, 78C is moved away from pulley 78C and towards pulley 78B thereby moving the shuttle box 30 to the rear in the direction indicated by arrow T. The stepper motor 72 turns the drive pulley 76 in the opposite direction to move the shuttle box forwards in the direction indicated by arrow T. FIG. 6 is a graph showing a representation of a velocity profile of the vacuum shuttle box as it is cycled by the drive system 70 between the front and rear positions on the module 20 (FIGS. 4A and 4C respectively show the shuttle box 30 at rear position B and at front position C). As can be realized from FIG. 6, the profile corresponds to a feed rate of about 120 or more ppm wherein the shuttle box completes a movement cycle in about 0.2 seconds (additional time is used for capturing the sheet media 100 as will be described below). The size of the drive pulley 76 is selected to provide the vacuum shuttle box with a desired stroke of about 22 mm in the preferred embodiment. In alternate embodiments, the shuttle box may have any other suitable stroke and cycle rate to generate any desired sheet media feed rate.

The vacuum shuttle box 30 preferably has a position sensor 94 which registers when the shuttle box 30 is in its home or rear position B. In FIGS. 2 and 3, the shuttle box 30 is shown in its home position B. Position sensor 94 may be a suitable electro-optical sensor comprising a light source and photocell to detect the light source when the shuttle box is in its home position. A suitable electro-optical sensor is manufactured by the Temic Corp., otherwise the position sensor may be a suitable electromagnetic, or even electro-mechanical sensor which precisely registers when the vacuum shuttle box reaches its home position B during the return stroke. When the module 20 is mounted to the apparatus 10, the position sensor 94 is connected by appropriate means (not shown), such as suitable wiring, to the apparatus controller 300. The controller 300 interrupts the stepper motor 72, and thus stops the motion of the shuttle box 30 when the sensor 94 registers that the vacuum shuttle box 30 is in the home position B. The module 20 may also include a suitable electro-mechanical limit switch 96 mounted to frame 21 to stop an overstroke of the shuttle box 30. When the shuttle box 30 trips the limit switch 96, the limit switch de-energizes the stepper motor 72, and possibly the apparatus 10, to prevent an overstroke of the vacuum shuttle box 30.

Still referring to FIGS. 2 and 3, the vacuum hose 34 has an inlet end 84 which is connected to an outlet hole (not shown) in the top plate 37 of the vacuum shuttle box 30. In alternate embodiments, the outlet hole may be located at any other desirable location on the vacuum shuttle box. The hose 34 is a flexible corrugated tube made of plastic, such as PVC, or any other suitable material including metal. As seen in FIGS. 2 and 3, in the preferred embodiment, the vacuum hose 34 extends from the shuttle box 30 in a direction substantially transverse to the direction in which the vacuum shuttle box 30 moves (as indicated by arrow T). The output end 86 of the vacuum hose 34 is located at an interface region 90 on one side 92 (see FIG. 2) of the module 20. The outlet end 86 is fixedly mounted by suitable means such as a clamp or bracket (not shown) to the frame 21 of the module 20. Accordingly, the inlet end 84 of the hose 34 moves with the vacuum shuttle box 30 when the box moves back and forth along rail 36, and the outlet end 86 of the hose remains fixed relative to the module 20. The hose 34 has sufficient length and flexibility to accommodate the relative movement between the outlet end 86 fixed to the frame 21, and the inlet end 84 which moves with a shuttle box 30. The outlet end 86 of the vacuum hose 34 is coupled to the vacuum system 6 of the apparatus 10 when the removable module 20 is mounted to the frame 12 of the apparatus as will be described in greater detail below.

As seen in FIGS. 2 and 3, the air fluffer assembly 28 is located on the module frame 21 somewhat to the rear from the home position B of the vacuum shuttle box 30. In the preferred embodiment, the air fluffer assembly 28 is configured to extend substantially transverse to the direction of motion, indicated by arrow T, of the vacuum shuttle box 30, though in alternate embodiments, the air fluffer assembly may have any other suitable configuration. The air fluffer assembly has an inlet port 112, a duct section 114, and an exhaust nozzle or section 116. The inlet port 112 is located at the inner face region 90 on the side 92 of the module 20. The inlet port 112 is sized to be coupled to a corresponding air outlet 4F (see FIG. 1) of the apparatus air supply 4, when the module 20 is mounted to the frame 12 of the apparatus as will be described in greater detail below. Duct section 114 connects the exhaust nozzle 116 to the inlet port 112. The inlet port 112 is fixedly mounted by a suitable bracket 120 to the frame 21 of the module 20. The nozzle 116 is supported from the duct section 114. The duct section 114 may be made from corrugated plastic, or metal, or may include telescoping sections (not shown), which allow the duct section 114 to telescope in/out in the direction indicated by arrow F (see FIG. 3). The duct 114 is sufficiently rigid to support the nozzle 116. The nozzle 116, which depends from the telescoping duct 114, may thus also move relative to the module frame 21 in the direction indicated by arrow F. The air fluffer assembly 28, preferably, includes a spring 122 which is located between the exhaust nozzle 116 and the inlet port 112. The spring 122 may be a coil spring helically wound around the telescoping duct 114. The spring 122 is preloaded as desired to bias the movable nozzle 116 away from the inlet port 112 which is fixed to the module frame 21. As seen in FIG. 2, the exhaust nozzle 116 has stop tabs or snubbers 124 which project below the nozzle. The nozzle 116 also includes a guide vane 118 which extends from the exhaust end 126 of the nozzle 116. The guide vane 118 is pivotably mounted to the nozzle 116 so that the vane may pivot up and down relative to the nozzle 116. As shown in FIG. 2, vane 118 includes two sidewalls or ribs 128 which project downward from the vane to give the vane a general channel configuration. When the air fluffer assembly 28 is connected to the air supply 4, air indicated by arrow Af is exhausted out of the nozzle 116 and channeled by vane 118 in a direction generally transverse to the process direction indicated by arrow T of the shuttle vacuum box 30.

As shown in FIGS. 2 and 3, the module 20 includes an overfluff baffle 130. The overfluff baffle 130 is a block formed from metal or plastic. The overfluff baffle 130 may be pivotably mounted to the horizontal support plate 44 of the module frame. Accordingly, the baffle 130 may be pivoted relative to the frame in order to raise or lower the lower surface 134 of the baffle. The overfluff baffle 130 is preferably located substantially aligned with the end 132 of the vane 118 on the exhaust nozzle 116 of the air fluffer assembly 28 (see FIG. 3).

As shown in FIGS. 2 and 3, the air knife assembly 26 is located in front of the vacuum shuttle box 30. In the preferred embodiment, the air knife assembly 26 is configured to extend substantially transverse to the process direction indicated by arrow T of the shuttle box 30, though in alternate embodiments, the air knife assembly may have any other desired configuration. The air knife assembly preferably includes a substantially rigid duct made of suitable metal or plastic. The air knife duct may include an inlet port 136, duct section 138, transition section 140, and air knife nozzle 146. Similar to the inlet port 112 of the air fluffer 28, the inlet port 136 of the air knife ducting is also located in the interface region 90 on the side 92 of the module frame 21. The inlet portion 136 of the air knife ducting is sized to be coupled to the corresponding air supply outlet 4K (see FIG. 1) of the air supply system 4, when the module 20 is mounted to the apparatus frame 12 as will be described below. The air duct section 138 extends from the inlet port 136 to the transition section 140. On the other side of the transition section 140 is the air knife nozzle 146. The transition section 140 is a tapering section which transitions between the generally round cross section of the inlet port 136 and duct section 138, to the narrow cross section of the air knife nozzle 146. The air knife nozzle 146 has a general elbow shape with the exhaust opening 152 facing the shuttle box 30 (see FIG. 3). The nozzle 146 preferably includes a number of internal vanes 148 which redirect air flow (indicated by arrows $A_k$) entering the nozzle 146 from the transition section 140 to exhaust substantially uniformly from the exhaust opening 152 facing the shuttle box 30. In addition, the air knife nozzle has an angled portion 150 proximate to exhaust 152. The angled portion 150 is angled upwards, as seen best in FIG. 3, (also see FIGS. 4A–4C) to direct the airflow $A_k$ from the exhaust opening 152 in an upwards direction. Hence, airflow $A_k$ from the air knife exhaust opening 150 moves both upwards and towards the shuttle box 30.

Figure 4A:
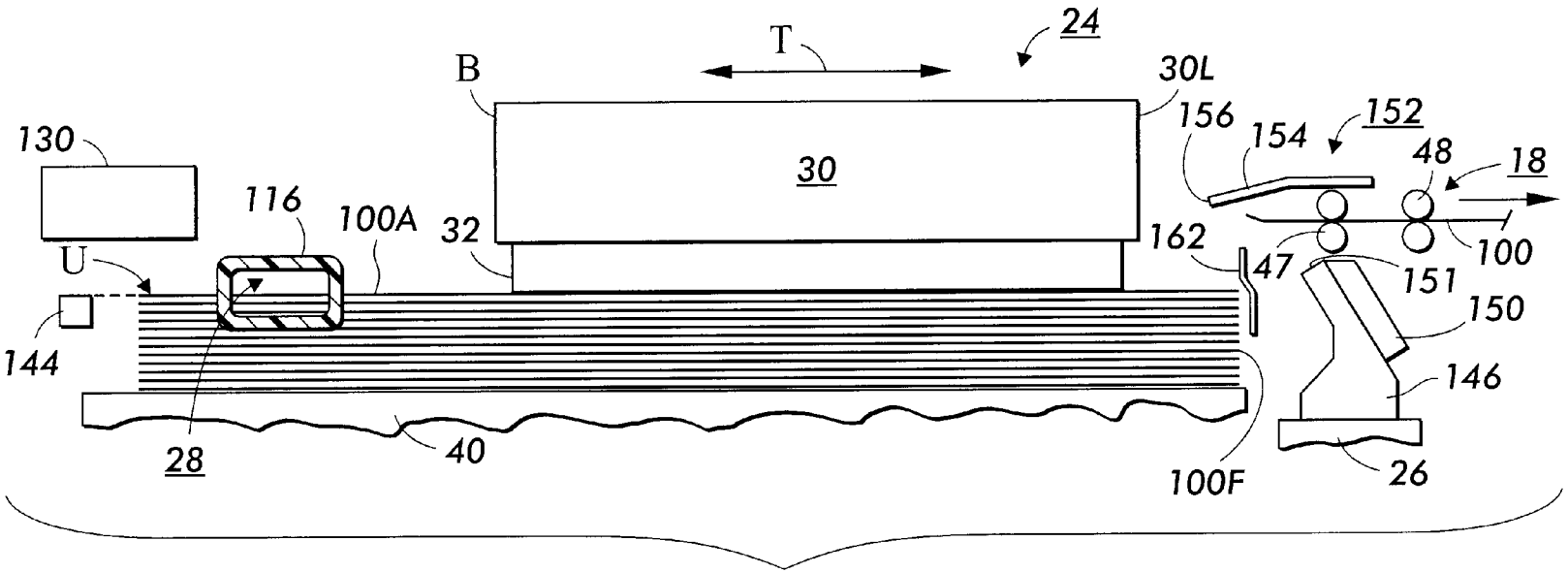
FIGS. 4A–4C respectively are schematic side elevation views of a vacuum shuttle box assembly of the shuttle feeder module, and a sheet media supply section of the image transfer apparatus in FIG. 1, showing the vacuum shuttle box assembly in three different positions relative to the media supply section.
Figure 4B:
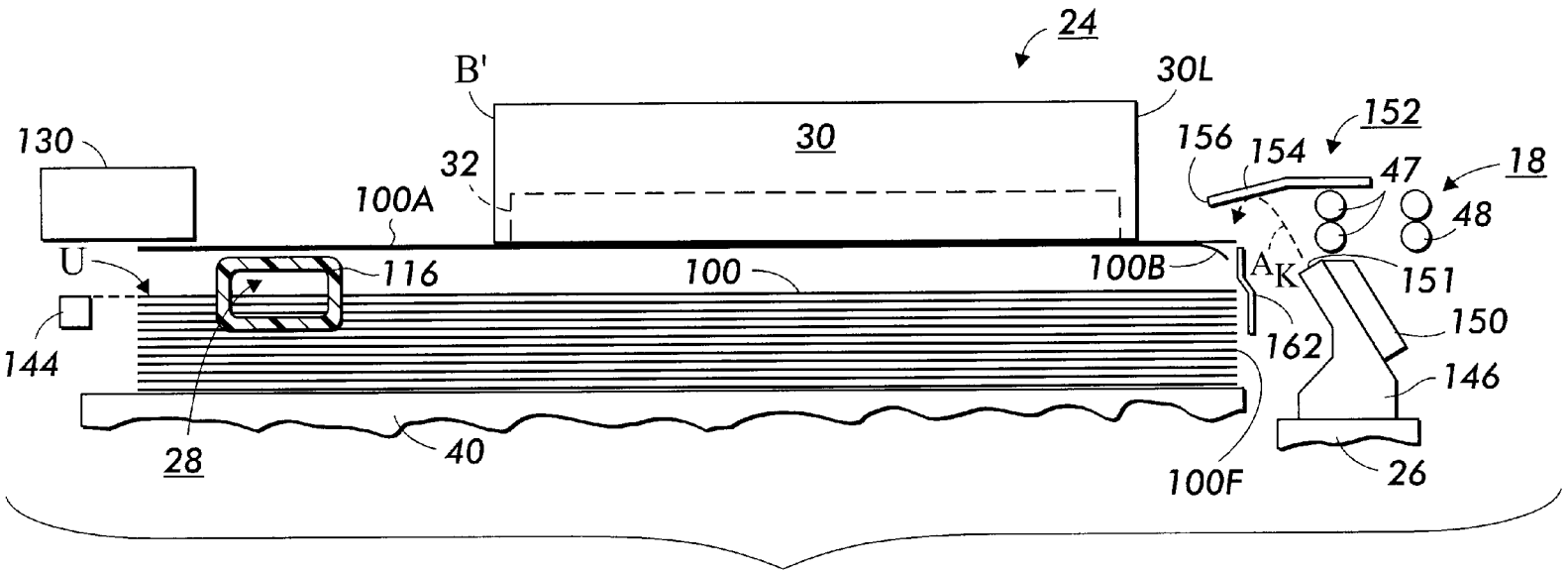
Figure 4C:
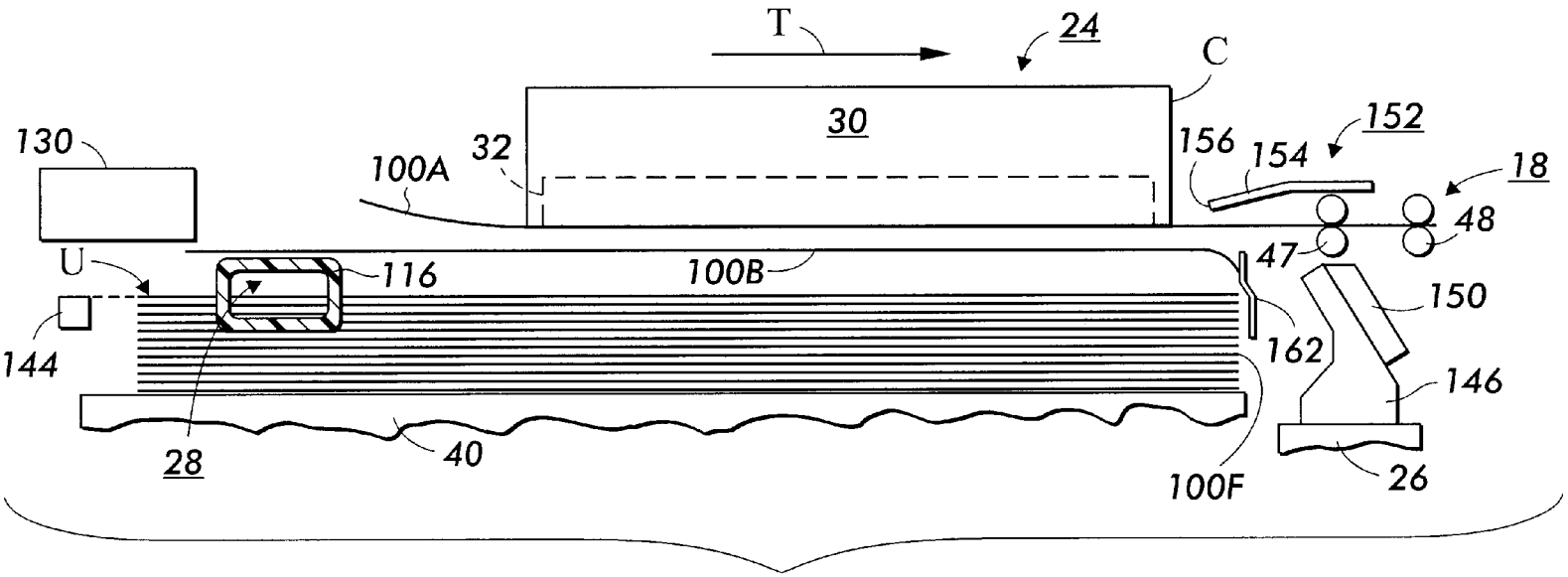

Referring now to FIGS. 2, and 4A–4C, the air knife assembly 26 preferably also includes an air deflector plate or vane 152. The deflector plate 152 is preferably a plate member made of suitable metal or plastic. The deflector plate 152 is mounted to the module frame 21 over the exhaust opening 152 of the air knife nozzle 146 (the plate 152 is not shown in FIG. 3 for purposes of clarity). As can be seen best in FIGS. 4A–4C, the deflector plate 152 has a portion 154 which overhangs the air knife exhaust opening 152 so that the air $A_k$ which exhausts from the air knife 26 strikes the over hanging portion 154 (see FIG. 4C). The over hanging portions 154 of the deflector plate 152 is angled downwards as shown in FIGS. 4A–4C. The deflector plate 152 may be movably mounted, using suitable fastening means, to the module frame 21 so that the position of the plate are relative to the air knife nozzle 146, and the angle of the plate may be adjusted as desired. The trailing edge 156 of the deflector plate 152 may be scalloped as shown in FIG. 2. The combination of downward angle of overlapping portion 154, and the scallop of the trailing edge 156 helps induce turbulent vortices in the air knife air flow $A_k$ deflected from the deflection plate 152.

The module 20 includes a support plate or fixture 160 with media grabbing prongs, or fangs 162 mounted thereon (see FIGS. 2, and 4A–4C). Support plate 160 is configured for example purposes to be mounted to the front side 50 of the module frame 21. The support plate 160 is preferably mounted between the vacuum shuttle box 30 and the air knife nozzle 146. As can be seen in FIGS. 4A–4C, the media grabbing fangs 162 may be located somewhat to the rear of the trailing edge 156 of the deflector plate 154. The support plate 160 may include vertically slotted holes 164 for fasteners (not shown) used to mount the support plate to the module frame. Accordingly, the vertical height of the support plate 160 may be adjusted (as indicated by arrow Y) relative to the module frame 21. In the preferred embodiment, the support plate has a pair of fangs 162 mounted thereon though in alternate embodiments, any number of grabbing fangs may be mounted to the support plate. Fangs 162, which are strips made form metal or plastic, are pivotably mounted on shaft 163 which is supported from the support plate 160 (see FIG. 2). The fangs 162 may thus be rotated about shaft 163 in order to further adjust the height and location of the tips of the fangs. Module 20 may also include take-away rollers 47 located on the module frame 21 in front of the shuttle box 30 as shown in FIG. 2. The take-away rollers 47 are mounted to the frame 21 to be substantially aligned with following rollers 48 of the transport system 18 (see FIG. 1) when the module 20 is mounted to the frame 12 of the apparatus 10. Take-away rollers 47 may be powered by a suitable drive system (not shown), or otherwise may be allowed to rotate freely. The removable module 20 further includes an electrical connector 98 which is mounted to the frame 21 at the interface region 90 of the module. The electrical connector 98 is capable of being connected to a mating electrical connector (not shown) to provide both power and allow bi-directional communication of data from the apparatus 10 to the module 20 when the module 20 is mounted to the apparatus frame 12.

In accordance with the scope of the present invention, the module 20 is readily mounted to the frame 12 of the apparatus 10 thereby mounting the vacuum shuttle box assembly 24, the air fluffer assembly 28, and the air knife assembly 26 to the apparatus in substantially one step. The removable module 20 is mounted with the mounting rail 52 (see FIG. 2) at the front 50 of the module and the side 92 of the frame 21 against the frame 12 of the apparatus as shown in FIG. 1. In this position, the direction of movement of the vacuum shuttle box 30 relative to the module (indicated by arrow T) is substantially aligned with the process direction (indicated by arrow P in FIG. 1) of the apparatus transport system 18. Fasteners may then be inserted through mounting holes 54 in the rail 52 as previously described to secure the module 20 to the apparatus frame 12. With the module 20 mounted in this position, the interface region 90 on the side 92 of the module is located facing the air outlets 4K, 4F and inlet 6I of the air supply and vacuum systems 4, 6 respectively. Each of the air outlets 4K, 4F of the air supply system 4, and the inlet 6I of the vacuum system 6, may be provided with spring loaded, rotate to lock collars (not shown) which may used to couple each outlet and inlet to the corresponding inlet ports 112, 136 and outlet 86 at the interface region 90 of the module. As noted previously, with the module 20 mounted to the frame 12, the air knife inlet port 136 is coupled to the supply outlet 4K of the air system 4. The air fluffer inlet port 112 is coupled in turn to the supply outlet 4F of the air system 4.

Referring now again to FIG. 1, the air supply system 4 of the apparatus 10, generally comprises an air pump or fan 4P, and a supply duct 4S. The supply duct 4S connects the air pump 4P to supply outlets 4K, 4F respectively feeding the air knife assembly 26 and the air fluffer assembly 28 when the module 20 is connected to the apparatus frame 12. The air supply system 4 is shown in FIG. 1 as having two supply outlets 4K, 4F, for example purposes, and the air supply system of the apparatus may have any desired number of supply outlets feeding air to any number of desired air powered systems of the apparatus. In alternate embodiments, the air knife assembly, and air fluffer assembly on the removable module may be respectively coupled to independent air supply systems. The air supply system 4 preferably includes an air heater 4H which may be disposed in the supply duct 4S. The heater 4H raises the temperature of the supply air, for example, by a difference in temperature of about 35° F. across the heater, to reduce the entrained moisture and increase the overall energy of the supplied air. The supply outlet 4K for the air knife may include a suitable air valve 4V, such as for example, a solenoid air valve, which can be cycled opened and closed at a desired rate in order to send pulses of air indicated by arrows $A_k$ in FIG. 3 into the air knife assembly 26. The air valve 4V operated by the controller 300, regulates the pulses of air in the air knife assembly 26 in synchronicity with movement of the shuttle box 30 as will be described below. Thus, as can be realized from FIGS. 1 and 3, when the module 20 is mounted to the frame 12, the air supply system 4 respectively feeds pulses of air $A_k$ into the air knife assembly 26 and dry, high energy air $A_f$ into the air fluffer assembly 28. The air pump 4P is of sufficient size to supply air $A_k$ to the air knife 26 at a nominal pressure of about 14.5 mmwg, and to supply air $A_f$ to the air fluffer 28 at a flow rate of about 19.5 CFM and pressure of about 11 mmwg. In alternate embodiments, the supply air to the air knife, in air fluffer may have any suitable pressure and flow rate.

With the module 20 mounted on frame 12 of the apparatus, the air outlet 86 of the vacuum hose 34 is coupled to the inlet 6I of the apparatus vacuum system 6. Vacuum system 6 generally comprises a vacuum pump 6P and ducting 6D coupling the inlet 6I to the vacuum pump. The ducting 6D and vacuum pump 6P are sized so that when coupled to the vacuum duct 34 of the vacuum shuttle box assembly, a nominal vacuum of about 23 mmwg may be drawn in the vacuum shuttle box 30. In alternate embodiments, the vacuum system may be capable of generating any other suitable vacuum in the shuttle box. Arrow V in FIG. 3 indicates the air drawn from the vacuum shuttle box 30 by the vacuum system 6, when the module 20 is mounted to the frame 12 of the apparatus 10.

FIGS. 4A–4C, and 5 show the relation of the vacuum shuttle box 30, the air fluffer nozzle 116, the air knife nozzle 146, overfluff baffle 130, and media grabbing fangs 162 relative to the stack of sheet media 100 in the supply section 116, (see also FIG. 1) when the module 20 is mounted is mounted to the frame 112 of the apparatus 10. The vacuum shuttle box 30, air fluffer nozzle 116, air knife nozzle 146, overfluff baffle 130, and media grabbing fangs 162 are disposed to allow rapid feeding of sheet media 100 from the stack to the apparatus transport system 118 at a rate of about 120 ppm or more. The configuration shown in FIGS. 4A–4C, and 5 is one example of a suitable configuration which will effect high sheet media feed rates in accordance with the present invention. In FIG. 4A, the vacuum shuttle box 30 is shown in its home position B. In FIG. 4C, the vacuum shuttle box 30 is moved in the direction indicated by arrow T to its forward position C. The vacuum shuttle box 30 is at a suitable height (of about 0.8 mm) relative to the sheet media 100 stack to allow the vacuum skirt 32 hanging from the box to contact the upper sheet 100A of the stack. In the home position B, the leading edge 30L of the shuttle box may be at a distance of about 15 mm from the front edge 100F of the sheet media stack. The air fluffer nozzle 116 is to the rear of the shuttle box 30 (see FIG. 4A). As can be seen in FIG. 5, the air fluffer nozzle 116 is biased by spring 122 (see FIG. 3) towards the stack of sheet media 100 and thus is self adjusting when the module 20 is mounted to the apparatus. The snubbers 124 on the nozzle may come into contact with the sheet media stack to form a narrow vertical gap 170 of about the 1 mm between the nozzle 116 and sheet media stack 100. As shown in FIG. 5, the vane 118 may extend over the sheet media 100 stack at an angle 172. The sidewalls 128 of the vane may extend substantially parallel to the top sheet of the sheet media stack. Air flow $A_f$ from the air fluffer nozzle 116 is directed against the side of the sheet media stack and also guided by vane 118 over the top sheet 100A of the stack. This causes a low pressure region over the top sheet 100A causing a tendency of the top sheet 100A to separate from the stack. The dry heated air $A_f$ exhausted from the air fluffer nozzle 116 also mitigates the adhesive effect of moisture between sheet media.

As seen in FIG. 4B, the vacuum region in the shuttle box 30, and low pressure region generated by the air fluffer 28 combined to cause the top sheet 100A of the stack to lift from the stack and become captured to the vacuum shuttle box 30 (position B'). Overfluff baffle 130 is located to minimize excess flutter or sheet instability of the sheet 100A. The height of the overfluff baffle lower surface 134 (see also FIG. 2) may be adjusted by pivoting the baffle 130. In the case shown in FIG. 4B, a second sheet 100B may adhere inadvertently due to electrostatic attraction to the upper sheet 100A as it is being captured by the vacuum shuttle box 30. As the top sheet 100A is lifted by the vacuum in the vacuum shuttle box 30, the skirt 32 is pushed upwards into the box 30. Controller 300 now opens the air valve 4V (see also FIG. 1) so that an air pulse $A_k$ is sent through the air knife 26. The air pulse $A_k$ escapes from the air knife nozzle and is deflected by deflector plate 152 against the front edges of the sheet media 100A, 100B held by the vacuum shuttle box. The vortices in the air pulse created by the deflector plate 152 tend to cause separation at the front edge between the multiple sheet media 100A, 100B held by the vacuum box 30. The upper sheet 100A remains secured to the vacuum shuttle box due to the significant suction between the sheet media 100A and the vacuum box 30. The sheet 100B adhering to the top sheet 100A tends to fall off due to the very low force generated by static electricity (barely greater than the weight of the sheet media 100B) holding the lower sheet 100B to the top sheet 100A. In FIG. 4C, the vacuum shuttle box is now moved forwards to position C. As the shuttle box 30 moves forwards, the front edge of the lower sheet 100B (if not previously detached by the air knife pulse $A_k$) is caught by the media grabbing fangs 162 and detached from the top sheet 100A which remains secured to the vacuum shuttle box 30 by the vacuum therein. The height of the tips on the media grabbing fangs 162 is adjusted to allow the top sheet 100A to pass over the fangs while catching the front edge of the other sheet media 100B adhering to the top sheet. The air knife 26 is shut when the vacuum shuttle box 30 is in position C allowing the top sheet 100A to enter unimpeded between the take-away rollers 47. Take away rollers 47 move the sheet media 100A to following rollers 48 in the apparatus. The vacuum in the vacuum shuttle box 30 is shut, and the box is vented through a suitable valve (not shown) to allow the sheet media 100A to move freely from the shuttle box. The shuttle box 30 may then be returned back to home position B shown in FIG. 4A, and the process may then be repeated. In the aforementioned manner, the apparatus may achieve a feed rate of about 120 ppm or more.

In accordance with the scope of the present invention, the positions of the vacuum shuttle box 30, air fluffer nozzle 116, the air knife nozzle 146, over fluff baffle 130, and media grabbing fangs 162 may be adjusted relative to a datum (not shown) before the module 20 is mounted to the frame 12 of the apparatus. The datum corresponds to the configuration of the sheet media 100 stacked in the supply section 16 of the apparatus 10. Hence, an operator may fine tune the positions of the vacuum shuttle box 30, the air fluffer nozzle 116, the air knife nozzle 146, the overfluff baffle 130, and media grabbing fangs 162 relative to the media stack at a time when access to the systems is readily available and adjustments may be easily made. The module 20 may then be mounted on the frame 12 after the positions of the above noted systems are adjusted to the optimal locations.

It should be understood that the foregoing description is only illustrative of the invention. Various alternatives and modifications can be devised by those skilled in the art without departing from the invention. Accordingly, the present invention is intended to embrace all such alternatives, modifications and variances which fall within the scope of the appended claims.

What is claimed is:

1. An image transfer apparatus shuttle feeder module comprising:

a module frame;

an air fluffer assembly supported from the module frame;

a vacuum shuttle box assembly supported from the module frame, the vacuum shuttle box assembly being movably mounted to the module frame to shuttle relative to the frame between first and second positions; and an air-knife assembly supported from the module frame;

wherein the module frame has attachment members adapted for removably mounting the module frame with the air fluffer assembly, vacuum shuttle box assembly, and air knife assembly thereon, to an image transfer apparatus in a predetermined location on the image transfer apparatus, wherein in the predetermined location the module frame is disposed relative to a sheet media supply section of the image transfer apparatus such that the air fluffer assembly, the vacuum shuttle box assembly, and the air knife assembly are operable for moving sheet media from the supply section to a different location on the image transfer apparatus without adjusting the location of the module frame, air fluffer assembly, vacuum shuttle box assembly, and air knife assembly after mounting the module frame to the image transfer apparatus.

2. A shuttle feeder module in accordance with claim 1, wherein the air fluffer assembly, vacuum shuttle box assembly, and the air knife assembly operate to move sheet media to a sheet media transport system having a sheet media take-away at the different location on the image transfer apparatus.

3. A shuttle feeder module in accordance with claim 2, wherein the vacuum shuttle box assembly is in the first position on the module frame when capturing sheet media from the sheet media supply section, and is in the second position on the module frame when releasing sheet media at the transport system sheet media take-away.

4. A shuttle feeder module in accordance with claim 1, wherein the air fluffer assembly, vacuum shuttle box assembly, and air knife assembly operate to move sheet media from the sheet media supply section one sheet at a time.

5. A shuttle feeder module in accordance with claim 1, further comprising a drive system mounted to the module frame for moving the vacuum shuttle box assembly relative to the module frame between the first and second positions.

6. A shuttle feeder module in accordance with claim 5, wherein the drive system includes a stepper motor, and a transmission drivingly connecting the stepper motor to the vacuum shuttle box assembly for moving the vacuum shuttle box assembly relative to the module frame between the first and second positions when the stepper motor is operated.

7. A shuttle feeder module in accordance with claim 6, wherein the vacuum shuttle box assembly is connected by a flexible tube to the vacuum suction port.

8. A shuttle feeder module in accordance with claim 7, wherein the vacuum shuttle box assembly comprises a vacuum shuttle box with a porous support surface for drawing a vacuum in the shuttle box, and skirts movably mounted to the vacuum shuttle box to form a seal between the vacuum shuttle box and sheet media captured by the vacuum shuttle box.

9. A shuttle feeder module in accordance with claim 1, wherein the air fluffer assembly comprises an exhaust nozzle with an air exhaust located proximate to sheet media in the sheet media supply section when the shuttle feeder module is mounted to the image transfer apparatus.

10. A shuttle feeder module in accordance with claim 9, wherein the nozzle has a vane protruding from the exhaust, and extending over sheet media in the sheet media supply section for directing a layer of air from the air fluffer over the sheet media in the media supply section.

11. A shuttle feeder module in accordance with claim 10, wherein the vane has a general channel shape with two tapered outer sidewalls and a plate member spanning therebetween.

12. A shuttle feeder module in accordance with claim 1, further comprising sensors for positioning the vacuum shuttle box assembly in the first position and in the second position on the module frame.

13. A shuttle feeder module in accordance with claim 1, wherein air knife assembly has an air exhaust located to direct an air stream against sheet media carried by the vacuum shuttle box assembly when the vacuum shuttle box assembly is located at the take away of the sheet media transport system.

14. An image transfer apparatus shuttle feeder module comprising:

a module frame;

an air fluffer assembly supported from the module frame;

a vacuum shuttle box assembly supported from the module frame, the vacuum shuttle box assembly being movably mounted to the module frame to shuttle relative to the frame between first and second positions; and an air knife assembly supported from the module frame;

wherein the module frame has attachment members adapted for removably mounting the module frame with the air fluffer assembly, vacuum shuttle box assembly, and air knife assembly thereon, to an image transfer apparatus having a sheet media supply section, the module frame being mounted in a predetermined location on the image transfer apparatus when the module frame is mounted to the image transfer device, wherein in the predetermined location the module frame is disposed relative to the sheet media supply section such that the air fluffer assembly, the vacuum shuttle box assembly, and the air knife assembly are operable for moving sheet media from the supply section to a different location on the image transfer apparatus, and further comprising an interface for interfacing with the image transfer apparatus when the shuttle feeder module is mounted to the image transfer apparatus, the interface including respective air intakes for the air fluffer assembly, and air knife assembly, and a vacuum suction port for the vacuum shuttle box assembly.

15. A shuttle feeder module in accordance with claim 14, wherein the air fluffer assembly comprises a flexible duct connecting the exhaust nozzle to the respective air intake at the module interface, and wherein the flexible air duct is spring loaded to bias the exhaust nozzle toward sheet media in the sheet media supply section.

16. An image transfer apparatus comprising:

a frame;

an imager mounted on the frame for generating an image on sheet media;

a media supply section connected to the frame for holding sheet media therein;

a sheet media transport system connected to the frame for transporting sheet media to the imager; and a shuttle feeder module removably mounted to the frame for feeding sheet media from the media supply section to the sheet media transport system, the shuttle feeder module having an air fluffer assembly, a vacuum shuttle box assembly, and an air knife assembly integral to the shuttle feeder module, wherein the air fluffer assembly, vacuum shuttle box assembly, and air knife assembly are configured on the shuttle feeder module to be removably connected to the frame and correspondingly to an air supply and a vacuum source substantially at the same time when the shuttle feeder module is mounted to the frame.

17. A image transfer apparatus in accordance with claim 16, wherein the shuttle feeder module feeds sheet media from the media supply section to a sheet media take-away section of the sheet media transport system.

18. A image transfer apparatus in accordance with claim 16, wherein the vacuum shuttle box assembly of the shuttle feeder module is adapted for shuttling on the shuttle feeder module between a first location and a second location, and wherein when the shuttle feeder module is mounted to the frame, the vacuum shuttle box is disposed to capture sheet media held in the media supply section when in the shuttle box is in the first location on the shuttle feeder module, and is disposed to release sheet media into the sheet media transport system when the shuttle box is in the second location on the shuttle feeder module.

19. A method for manufacturing an image transfer apparatus, the method comprising the steps of:

providing the image transfer apparatus with a frame having an imager, a media supply section, and a media transport system mounted to the frame;

attaching an air fluffer assembly, a vacuum shuttle box assembly, and an air knife assembly to a module frame for forming an integral shuttle feeder module; and mounting the shuttle feeder module as a unit to the frame of the image transfer apparatus, wherein the air fluffer assembly, vacuum shuttle box assembly, and air knife assembly integral to the shuttle feeder module are connected to the frame of the image transfer apparatus in one step when the shuttle feeder module is mounted to the frame; and providing the frame of the image transfer apparatus with an air supply, and a vacuum source, the air supply being respectively connected substantially at the same time to the air fluffer assembly and to the air knife assembly, and the vacuum source being connected to the vacuum shuttle box assembly when the shuttle feeder module is mounted to the frame of the image transfer apparatus.

20. A method in accordance with claim 19, wherein when the shuttle feeder module is mounted to the frame of the image transfer apparatus, the air fluffer assembly and the air knife assembly are respectively connected to the air supply at substantially the same time the vacuum shuttle box assembly is connected to the vacuum source.

21. A method in accordance with claim 19, wherein the frame of the image transfer apparatus is provided with an interface for interfacing with the shuttle feeder module when the shuttle feeder module is mounted to the frame, the interface having air supply outlets for supplying air to the air fluffer assembly and the air knife assembly, and having a vacuum suction opening for providing vacuum suction to the vacuum shuttle box assembly.

* * * * *